US009151260B2

(12) United States Patent
Suzuki

(10) Patent No.: US 9,151,260 B2
(45) Date of Patent: Oct. 6, 2015

(54) FUEL INJECTION VALVE

(75) Inventor: Hisao Suzuki, Mishima (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 14/240,208

(22) PCT Filed: Aug. 22, 2011

(86) PCT No.: PCT/JP2011/068872
§ 371 (c)(1),
(2), (4) Date: Feb. 21, 2014

(87) PCT Pub. No.: WO2013/027257
PCT Pub. Date: Feb. 28, 2013

(65) Prior Publication Data

US 2014/0191065 A1 Jul. 10, 2014

(51) Int. Cl.
*F02M 61/00* (2006.01)
*F02M 63/00* (2006.01)
*F02M 61/18* (2006.01)

(52) U.S. Cl.
CPC ..... *F02M 63/0033* (2013.01); *F02M 61/1813* (2013.01); *F02M 61/1833* (2013.01); *F02M 61/1853* (2013.01)

(58) Field of Classification Search
CPC ..... F02M 51/0671; F02M 61/1826; F02M 61/168; F02M 2200/8053; F02M 2200/8069
USPC ..... 239/533.2, 533.12, 533.14, 494, 496
See application file for complete search history.

(56) References Cited

U.S. PATENT DOCUMENTS

| | | | | |
|---|---|---|---|---|
| 6,311,901 | B1 * | 11/2001 | Imoehl et al. | 239/533.2 |
| 6,848,635 | B2 * | 2/2005 | Xu | 239/533.12 |
| 2004/0074996 | A1 | 4/2004 | Munezane et al. | |
| 2004/0104285 | A1 | 6/2004 | Okamoto et al. | |
| 2004/0217204 | A1 | 11/2004 | Sugimoto et al. | |
| 2005/0258277 | A1 * | 11/2005 | Joseph | 239/533.14 |
| 2006/0043218 | A1 | 3/2006 | Holzgrefe et al. | |

(Continued)

FOREIGN PATENT DOCUMENTS

| | | | |
|---|---|---|---|
| DE | 102009002321 | A1 | 12/2009 |
| EP | 1108885 | A2 | 6/2001 |
| FR | 2792686 | A1 | 10/2000 |

(Continued)

*Primary Examiner* — Davis Hwu
(74) *Attorney, Agent, or Firm* — Sughrue Mion, PLLC

(57) ABSTRACT

A fuel injection valve that can favorably reduce the film thickness of fuel ejected from an outlet of an injection hole without relying on increase of the fuel pressure, whereby atomization of fuel spray can be favorably promoted, is provided.

A fuel passage (16) through which the fuel flows is formed in the interior of the fuel injection valve (10). An injection-hole plate (18) as a member that separates an injection space (20) into which the fuel is injected, from the fuel passage (16), is provided in which a plurality of injection holes (22) for ejecting the fuel from the fuel passage (16) toward the injection space (20) are formed. The injection-hole plate (18), as viewed from the outlet side of the injection hole (22), is formed with an injection-hole outlet-side groove (24) connected to the injection hole (22) in a region (inner wall surface 22*b*) opposed to a main flow direction of the fuel directed toward the injection hole (22) along an inner wall surface (18*a*) of the injection-hole plate (18). The injection-hole outlet-side groove (24) is formed so as to extend in a direction away from the injection hole (22).

5 Claims, 6 Drawing Sheets

(56) References Cited

U.S. PATENT DOCUMENTS

| | | | |
|---|---|---|---|
| 2010/0282872 | A1 | 11/2010 | Krause |
| 2011/0220739 | A1 | 9/2011 | Sakai |

FOREIGN PATENT DOCUMENTS

| | | | |
|---|---|---|---|
| JP | 2002-364496 | | 12/2002 |
| JP | 2003-227443 | A | 8/2003 |
| JP | 2004-197628 | A | 7/2004 |
| JP | 2004-332657 | A | 11/2004 |
| JP | 2004-340121 | | 12/2004 |
| JP | 2005-127186 | | 5/2005 |
| JP | 2007-040111 | | 2/2007 |
| JP | 2008111372 | A | 5/2008 |
| JP | 2009-030572 | A | 2/2009 |
| JP | 2009-103035 | | 5/2009 |
| JP | 2010-065541 | A | 3/2010 |
| JP | 2010-508468 | | 3/2010 |
| JP | 2010-180784 | | 8/2010 |
| WO | 03067076 | A1 | 8/2003 |

* cited by examiner (A)

(B)

FUEL INJECTION VALVE

TECHNICAL FIELD

This invention relates to a fuel injection valve, and particularly relates to a fuel injection valve suitable for injecting fuel into an internal combustion engine.

BACKGROUND ART

Conventionally, a fuel injection valve used in an internal combustion engine is disclosed in Patent Document 1, for example. The conventional fuel injection valve includes an injection-hole plate in which a plurality of injection holes through which fuel is ejected to the outside is formed. The axis of injection hole is inclined toward the outer side of the injection-hole plate (the upstream side of a main flow direction of the fuel directed to the injection hole), as it proceeds from the inlet side of the injection hole to the outlet side thereof. Also, the injection hole has a recessed portion formed in an inner wall of the injection hole on the upstream side of the main flow direction of the fuel, such that the recessed portion extends from an inlet edge portion of the injection hole to an outlet edge portion of the injection hole.

The applicant recognizes documents as listed below, including the above-indicated document, as those related to the present invention.

PRIOR ART DOCUMENTS

Patent Documents

Patent Document 1: Japanese Patent Application Publication No. 2010-65541

Patent Document 2: Japanese Patent Application Publication No. 2003-227443

Patent Document 3: Japanese Patent Application Publication No. 2004-332657

Patent Document 4: Japanese Patent Application Publication No. 2004-197628

Patent Document 5: Japanese Patent Application Publication No. 2009-30572

SUMMARY OF THE INVENTION

Problems to be Solved by the Invention

In order to improve the performance (such as the fuel economy and the power) of the internal combustion engine, and reduce exhaust emissions, atomization of fuel spray is highly required of the fuel injection valve. As a means for promoting atomization of fuel spray, there is a method for reducing the film thickness of the fuel ejected from the outlets of the injection holes. For reduction of the film thickness of the fuel, it is effective to improve the flow rate of the fuel. Then, it is considered to increase the fuel pressure, in an attempt to improve the flow rate of the fuel. However, increasing the fuel pressure entails problems, such as an increase in the cost of a pressure boost system, and fuel deposition onto inner wall surfaces of the internal combustion engine due to improvement of the flow rate of the fuel.

This invention has been developed so as to solve the problems as described above, and aims at providing a fuel injection valve that can favorably reduce the film thickness of fuel ejected from an outlet of an injection hole without relying on increase of the fuel pressure, whereby atomization of fuel spray can be favorably promoted.

Arrangement for Solving the Problems

The present invention provides a fuel injection valve that injects fuel, and includes a fuel passage, and an injection-hole forming member.

The fuel passage is formed in an interior of the fuel injection valve, and allows the fuel to flow therethrough.

The injection-hole forming member is a member that separates an injection space into which the fuel is injected, from the fuel passage, and is formed with at least one injection hole for ejecting the fuel from the fuel passage toward the injection space.

Then, the injection-hole forming member is formed with an injection-hole outlet-side groove. With the injection-hole forming member viewed from an outlet side of the injection hole, the injection-hole outlet-side groove is connected to the injection hole in a region thereof opposed to a main flow direction of the fuel directed toward the injection hole along a wall surface of the injection-hole forming member inside the fuel injection valve. Also, the injection-hole outlet-side groove is formed so as to extend in a direction away from the injection hole.

According to the invention, the injection-hole outlet-side groove is provided in an outlet portion of the injection hole, so that a part of the fuel flowing into the injection hole is guided to the injection-hole outlet-side groove. With this arrangement, the flow amount of main fuel ejected from the injection hole without being guided to the injection-hole outlet-side groove is reduced, so that the film thickness of the main fuel ejected from the injection hole can be effectively reduced. Also, by utilizing the injection-hole outlet-side groove in addition to the injection hole, it becomes possible to disperse fuel spray injected into the injection space over a wider range, as compared with the case where such an injection-hole outlet-side groove is not provided. In this point, too, reduction of the film thickness of the injected fuel can be further promoted. Through the reduction of the film thickness of the injected fuel and the promotion of dispersion as described above, contact between the fuel and air in the injection space is promoted. Thus, promotion of atomization of fuel spray can be favorably realized. Then, the promotion of atomization of fuel spray can be realized by devising the shape of the surrounding of the injection hole, without relying on increase of the fuel pressure.

Also, the injection-hole outlet-side groove according to the invention may be formed as a groove that extends in a direction in which the fuel flowing into the injection hole is guided along an inner wall surface of the injection hole.

This arrangement makes it possible to guide the fuel to the injection-hole outlet-side groove, without disturbing but utilizing the flow of the fuel that flows along the inner wall surface of the injection hole as it flows from the inlet side to the outlet side in the injection hole. Consequently, the flow rate of the fuel injected from the injection-hole outlet-side groove can be kept extremely high, and, in this point, too, the reduction of the film thickness of the injected fuel is promoted.

Also, the injection-hole outlet-side groove according to the invention may be a pair of grooves formed in V shape such that the grooves are inclined toward an upstream side of the main flow direction of the fuel, in the injection-hole forming member as viewed from the outlet side of the injection hole.

The fuel deflected to the inner wall surface of the injection hole on the side opposed to the main flow direction, after flowing into the injection hole in the main flow direction of the fuel, spreads while branching to the right and left along the inner wall surface, as it flows from the inlet side to the outlet side in the injection hole. Accordingly, by forming the injection-hole outlet-side grooves as a pair of grooves formed in V shape oriented in the direction as described above, it is possible to effectively take out a part of the fuel while reducing the groove depth, even in the case where the groove depth is restricted for a reason in terms of the strength of the injection-hole forming member, for example.

Also, the injection-hole forming member according to the invention may be formed with an injection-hole inlet-side groove and a fuel bypass. With the injection-hole forming member viewed from an inlet side of the injection hole, the injection-hole inlet-side groove may be formed at a position close to the injection hole, in a region thereof opposed to the main flow direction of the fuel. Then, the fuel bypass may be a passage communicating with the injection-hole inlet-side groove, and may be formed so as to extend through the injection-hole forming member without intersecting the injection hole.

With the injection-hole inlet-side groove and the fuel bypass thus provided, it is possible to allow the fuel flow opposed to the main flow to escape into the injection-hole inlet-side groove. Therefore, the fuel flow opposed to the main flow can be prevented from entering the injection hole. As a result, the flow rate of the main flow is prevented from being reduced due to interference of this fuel flow, and reduction of the film thickness of the fuel injected from the injection hole can be prevented from being impeded. Also, with this arrangement, the fuel flowing into the injection-hole inlet-side groove is injected into the injection space via the fuel bypass, without joining the fuel flow in the injection hole. Thus, the flow of the fuel flowing from the injection-hole inlet-side groove is an independent fuel flow that does not join the main fuel flow through the injection hole, so that the main fuel flow can be prevented from being disturbed or blocked by this fuel flow.

Also, the fuel bypass according to the invention may be formed as a passage that communicates the injection-hole inlet-side groove with the injection-hole outlet-side groove.

With this arrangement, the injection-hole outlet-side groove for taking out a part of the fuel flowing into the injection hole is utilized as a passage for ejecting the fuel that has passed through the fuel bypass after flowing from the injection-hole inlet-side groove. As a result, the injection direction of the fuel from the injection-hole inlet-side groove side is aligned with the injection direction of the injection-hole outlet-side groove.

Also, the injection hole according to the invention may be formed such that a passage cross-sectional area of an outlet-side region thereof becomes larger toward an upstream side of the main flow direction of the fuel, relative to a passage cross-sectional area of an inlet-side region thereof.

Thus, the injection hole is formed so that the passage cross-sectional area of the outlet-side region becomes larger toward the upstream side of the main flow direction of the fuel, relative to the passage cross-sectional area of the inlet-side region, so that separation of the fuel that flows into the injection hole can be promoted; therefore, the fuel flowing into the injection hole in the main flow direction of the fuel can be effectively deflected to the downstream region as viewed in the main flow direction. As a result, reduction of the film thickness of the fuel ejected from the outlet of the injection hole can be promoted. Accordingly, the effects of this invention as described above can be more effectively brought out, since the injection hole having an arrangement of effectively deflecting the fuel injected into the injection hole, to the downstream region as viewed in the main flow direction, is provided as a pre-condition.

MODES FOR CARRYING OUT THE INVENTION

Embodiment 1

Figure 1:
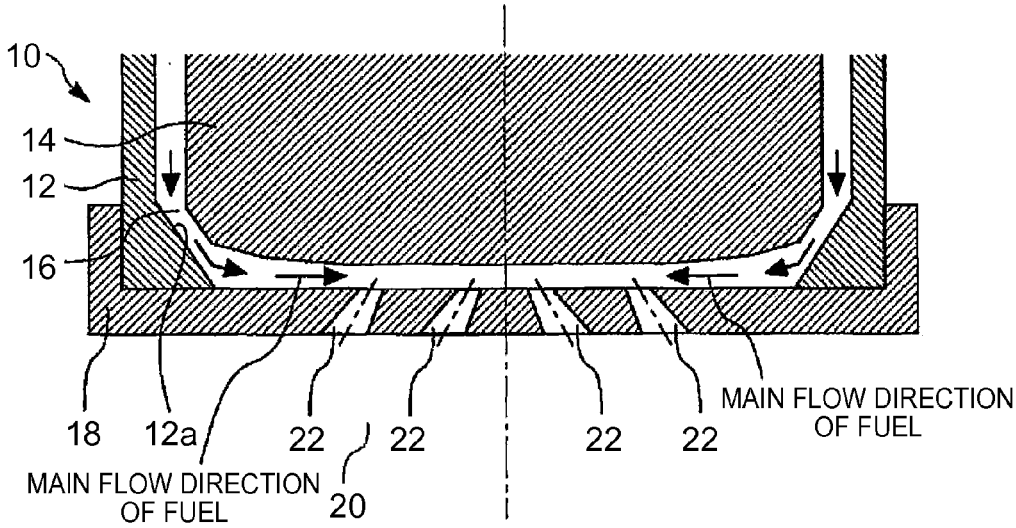
FIG. 1 is a cross-sectional view showing the construction of a distal end portion on one side of a fuel injection valve of an embodiment 1 of this invention, at which fuel injection is performed.
Figure 2:
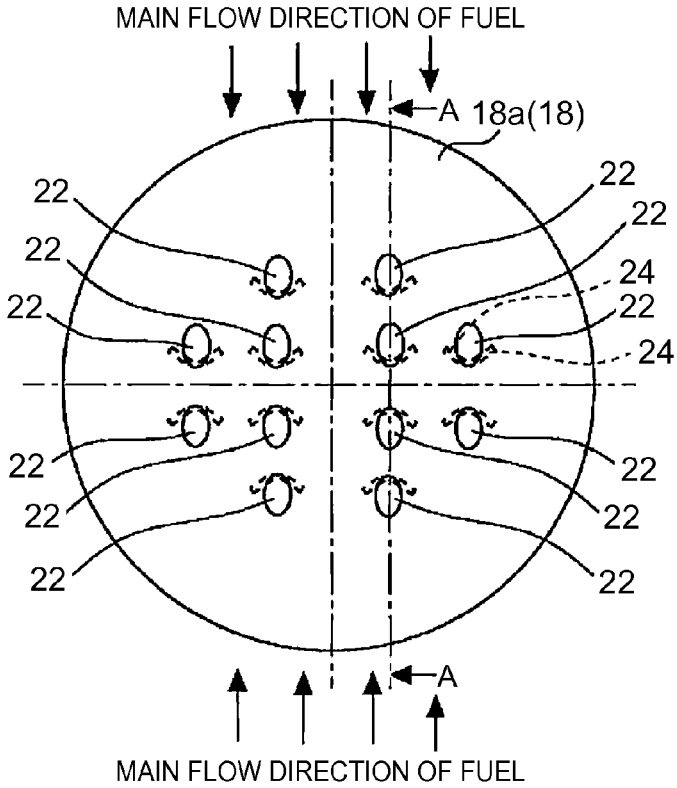
FIG. 2 is a view of an injection-hole plate as seen in an axial direction of the fuel injection valve (from the inlet side of injection holes).

FIG. 1 is a cross-sectional view showing the construction of a distal end portion on one side of a fuel injection valve 10 of an embodiment 1 of the invention, at which fuel injection is performed. Also, FIG. 2 is a view of an injection-hole plate 18 as seen in the axial direction of the fuel injection valve 10 (from the inlet side of injection holes). FIG. 1 is a cross-sectional view showing the fuel injection valve 10 cut along line A-A shown in FIG. 2.

The fuel injection valve 10 shown in FIG. 1 is a fuel injection valve suitable for injecting fuel into an internal combustion engine (preferably, into an intake port). However, the fuel injection valve 10 may be installed on the internal combustion engine such that it can directly inject fuel into a cylinder of the internal combustion engine.

As shown in FIG. 1, the fuel injection valve 10 includes a generally cylindrical valve body 12. A generally columnar needle valve 14 is placed inside the valve body 12 such that the needle valve 14 can freely reciprocate. A fuel passage 16 through which the fuel flows is formed between an inner circumferential surface of the valve body 12 and an outer circumferential surface of the needle valve 14. High-pressure fuel is supplied to the fuel passage 16, from the upper side of the fuel passage 16 as viewed in FIG. 1.

A seat portion 12*a* on which the needle valve 14 can be seated is formed on the inner circumferential surface of the valve body 12 in the vicinity of a distal end of the needle valve 14. More specifically, when an electromagnet (not shown) included in the fuel injection valve 10 does not generate magnetic force, the needle valve 14 is arranged to be seated on the seat portion 12*a*. In this case, flow of the fuel toward the downstream side of the seat portion 12*a* is shut off. On the other hand, when the electromagnet is supplied with excitation current and generates magnetic force, the needle valve 14 is arranged to move away from the seat portion 12*a*. As a result, the high-pressure fuel stored upstream of the seat portion 12*a* is supplied to the downstream side of the seat portion 12*a*.

Also, a generally disk-shaped injection-hole plate 18 is mounted at a distal end portion of the fuel injection valve 10, as a member that separates the fuel passage 16 downstream of the seat portion 12*a* from an injection space (here, the interior of the intake port) into which the fuel is injected. The injection-hole plate 18 is formed with a plurality of injection holes 22.

More specifically, the plural injection holes 22 (in this embodiment, 12 holes as one example) are arranged at given intervals in a pattern shown in FIG. 2. When the needle valve 14 moves away from the seat portion 12*a*, the fuel that has passed the seat portion 12*a* flows along a wall surface 18*a* of the injection-hole plate 18 on the inner side of the fuel injection valve 10 (which may be simply called "inner wall surface" of the injection-hole plate 18), and then flows into the respective injection holes 22. Here, the direction of main (the strongest) fuel flow, out of flows of the fuel toward the respective injection holes 22 along the inner wall surface 18*a* of the injection-hole plate 18 on the downstream side of the seat portion 12*a*, will be called "main flow direction of fuel". Namely, the main flow direction of the fuel mentioned herein is specified as a direction of fuel flow during a stage before the fuel flows into the respective injection holes 22 (a stage in which the fuel flows along the inner wall surface 18*a* of the injection-hole plate 18).

The main flow direction of the fuel toward the respective injection holes 22 can vary depending on the structure and specifications of the fuel injection valve 10 as pre-conditions. In the fuel injection valve 10 of this embodiment, the direction of flow from the upper side in FIG. 2 toward the center side of the injection-hole plate 18, and the direction of flow from the lower side in the same figure toward the center side of the injection-hole plate 18, are deemed as the main flow directions of the fuel. This is because fuel accumulating portions (not shown) that are larger in radial directions than the other regions exist respectively in the fuel passage 16 upstream of the seat portion 12 as viewed in these main flow directions of the fuel, and flows of the fuel that flows from the fuel accumulating portions onto the inner wall surface 18*a* of the injection-hole plate 18 through the seat portion 12*a* are stronger than flows of the fuel that flows from the right and left sides in FIG. 2 onto the injection-hole plate 18. In addition, the main flow direction of the fuel as defined above is assumed in advance in the design stage, as the main flow direction of the fuel that flows toward the respective injection holes 22 along the inner wall surface 18*a* of the injection-hole plate 18.

As shown in FIG. 2, each of the injection holes 22 has an oval cross-sectional shape. Then, each injection hole 22 is formed in the injection-hole plate 18, such that the direction of the long axis of its oval shape coincides with the above-indicated main flow directions.

Also, as shown in FIG. 1, each injection hole 22 is formed such that the passage cross-sectional area of an outlet-side region of the hole becomes larger toward the upstream side of the main flow direction (in this embodiment, the outer side of the injection-hole plate 18), relative to the passage cross-sectional area of an inlet-side region thereof. More specifically, each injection hole 22 is formed such that its passage cross-sectional area increases, from the inlet side to the outlet side, toward the upstream side of the main fuel direction of the fuel. In addition, in order to obtain this injection-hole shape, each injection hole 22 of this embodiment employs a tapered shape that broadens from the inlet side toward the outlet side, as shown in FIG. 1. In the fuel injection valve 10 of this embodiment, the injection-hole axis of each injection hole 22 (a straight line obtained by connecting a center point of the injection hole 22 at the inlet with a center point of the injection hole 22 at the outlet) is arranged to be inclined to be closer to the upstream side of the main flow direction of the fuel (the outer side of the injection-hole plate 18), as it proceeds from the inlet side of the injection hole 22 toward the outlet side, so as to adjust the direction of the fuel ejected from the injection hole 22 to a target direction.

Figure 3:
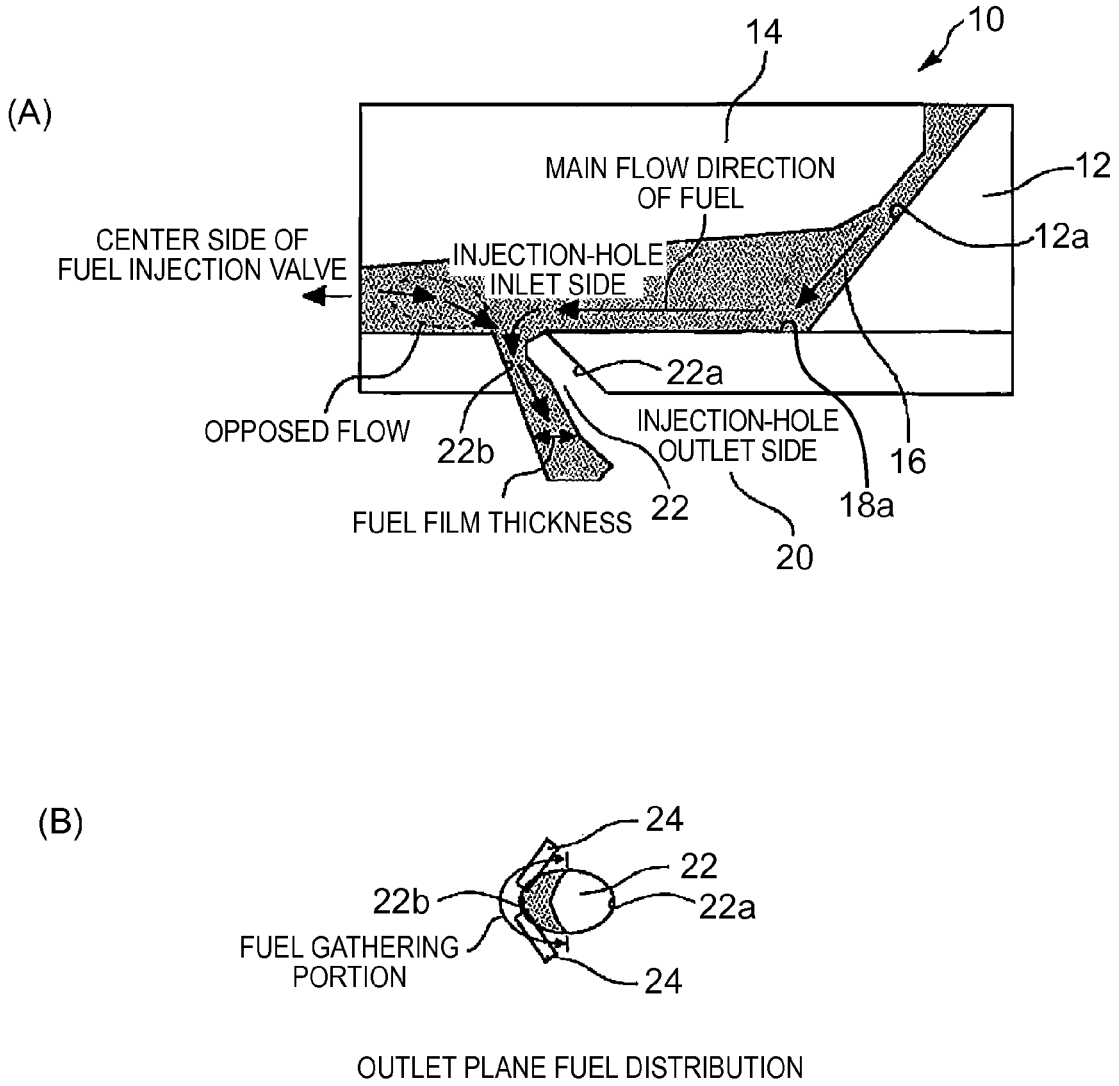
FIG. 3 is a view showing flow of fuel around an injection hole.

FIG. 3 is a view showing flow of the fuel around the injection hole 22. FIG. 3(B) is a view of the injection hole 22 shown in FIG. 3(A) as seen from the outlet side thereof.

According to the fuel injection valve 10 of this embodiment, the fuel that has passed the seat portion 12*a* at the time of valve opening is directed toward each injection hole 22 along the inner wall surface 18*a* of the injection-hole plate 18, as described above. In the case where this method is employed, when the fuel flowing in the main flow direction of the fuel flows into the inlet of the injection hole 22, separation of the fuel is promoted in a region having an acute angle due to the presence of a tapered portion 22*a* of the injection hole 22, so that the fuel that flows swiftly into the injection hole 22 in the main flow direction is pressed against an inner wall surface 22*b* opposite to the tapered portion 22*a*. As a result, the fuel flowing into the injection hole 22 is deflected to and collected on the side of the inner wall surface 22*b* on the downstream side (opposite to the tapered portion 22*a*) in the main flow direction of the fuel, as shown in FIGS. 3(A) and (B). Then, the fuel deflected in the injection hole 22 proceeds to the downstream side along the inner wall surface 22*b* while branching to the right and left, and is injected into the injection space (the interior of the intake port).

As the film thickness (as defined in FIG. 3(A)) of the fuel in the outlet portion of the injection hole is smaller, contact and shearing between the fuel and air take place earlier, whereby the diameter of fuel droplets is reduced (namely, the fuel is atomized), and the vaporization time of the fuel is reduced. Accordingly, promotion of atomization of the fuel owing to reduction of the film thickness of the fuel injected from each injection hole 22 is effective to improvement of the performance (such as the fuel economy and power) of the internal combustion engine and reduction of exhaust emissions. To reduce the film thickness of the fuel, it is effective to improve the flow rate of the fuel. In order to improve the flow rate of the fuel, it may be proposed to increase the fuel pressure. However, increasing the fuel pressure entails problems, such as an increase in the cost of a pressure boost system, and fuel deposition onto inner wall surfaces of the internal combustion engine (wall surfaces of the intake port and intake valve, in the port-injection-type fuel injection valve 10 of this embodiment) due to improvement of the flow rate of the fuel.

To solve the above-described problems, in this embodiment, a pair of injection-hole outlet-side grooves 24 connected to the injection hole 22 at a region (inner wall surface 22*b*) opposed to the main flow direction of the fuel directed to the injection hole 22 along the inner wall surface 18*a* of the injection hole plate 18, as viewed from the outlet side of the injection hole 22, are formed in the injection-hole plate 18, as shown in FIG. 3(B). The injection-hole outlet-side grooves 24 are formed as notched grooves that extend in directions away from the injection hole 22.

Figure 4:
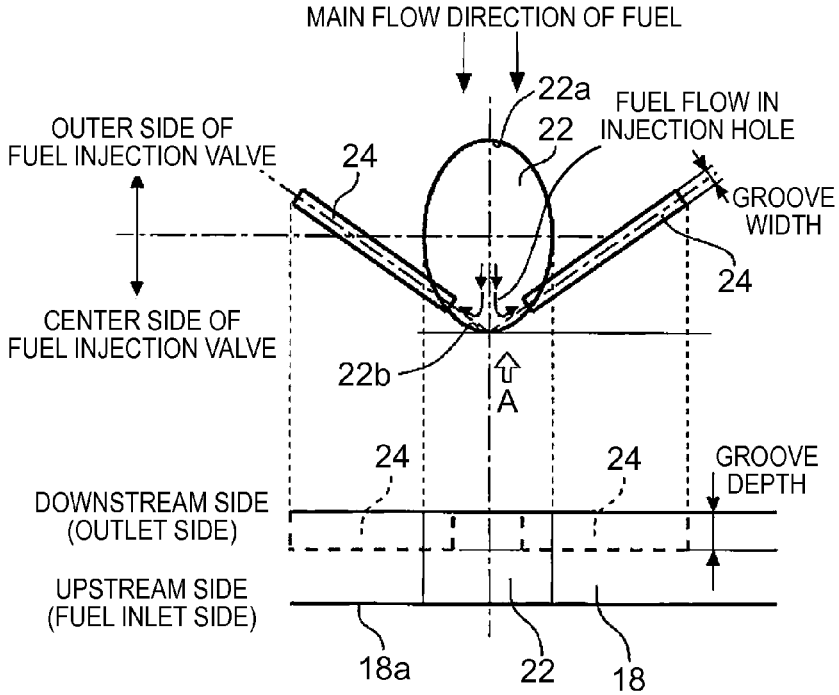
FIG. 4 is a view useful for explaining the detailed shape of injection-hole outlet-side grooves shown in FIG. 3(B).

FIG. 4 is a view useful for explaining the detailed shape of the injection-hole outlet-side grooves 24 shown in FIG. 3(B). More specifically, FIG. 4(A) is a view of the injection hole 22 and the injection-hole outlet-side grooves 24 as seen from the outlet side of the injection hole, and FIG. 4(B) is a view of the injection hole 22 and the injection-hole outlet-side grooves 24 as seen in the direction of arrow A shown in FIG. 4(A).

As described above, the fuel flowing into the injection hole 22 collects on the side of the region (inner wall surface 22*a*) on the downstream side of the main flow direction (see FIG. 3(B)). The fuel collected in this portion spreads while branching to the right and left, as the fuel flows from the inlet side to the outlet side in the injection hole 22, as shown in FIG. 4(A). In order to guide (take out) a part of the fuel flowing along the inner wall surface 22*b* without disturbing the flow, the injection-hole outlet-side grooves 24 of this embodiment are formed as grooves (recesses) that extend in directions in which the fuel flowing into the injection hole 22 is guided along the inner wall surface 22*b*.

More specifically, the injection-hole outlet-side grooves 24 of this embodiment are formed as a pair of grooves that are formed in V shape such that the grooves are inclined toward the upstream side of the main flow direction, and also formed in the shape of straight lines, when the injection-hole plate 18 is viewed from the outlet side of the injection hole 22. Also, the width of the injection-hole outlet-side grooves 24 is set so as to be sufficiently smaller than the injection hole size. In addition, the width of the injection-hole outlet-side grooves 24 is preferably equal to or smaller than one half of the width of the injection hole 22 as measured in the direction of the long axis of the oval shape. The reason is as follows. Namely, since the fuel is deflected to the side of the inner wall surface 22*b* when it flows into the injection hole 22, the thickness of the fuel in the injection hole 22 is about one half of the width dimension as measured in the long-axis direction of the injection hole 22, as shown in FIG. 3(B). Therefore, the width of the injection-hole outlet-side grooves 24 is preferably set to the above-indicated dimension so that a part of the fuel deflected to one side can be taken out. The depth of the injection-hole outlet-side grooves 24 may be constant, or may be reduced as the distance from the injection hole 22 increases, for example.

Figure 5:
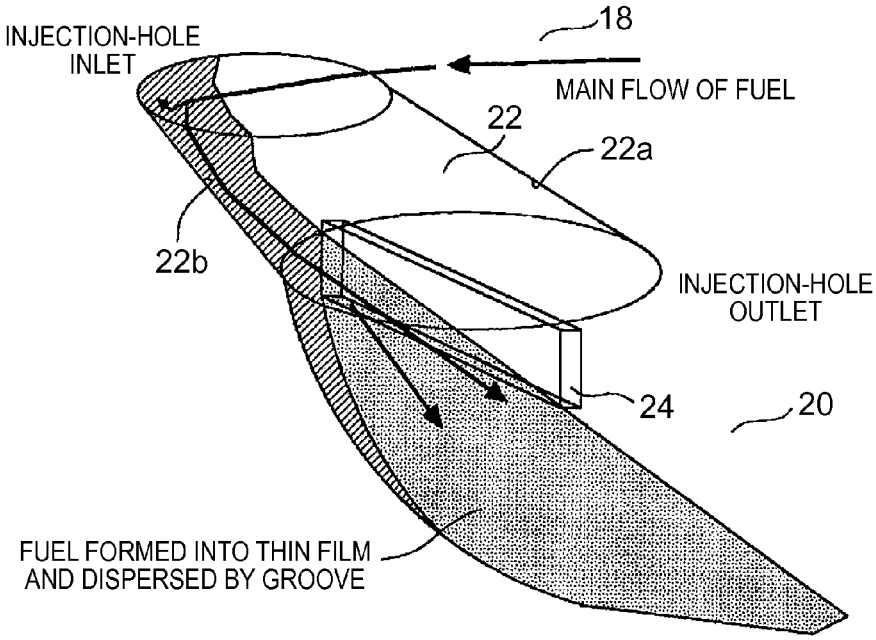
FIG. 5 is a perspective view showing flow of fuel injected through the injection hole and the injection-hole outlet-side groove.
Figure 6:
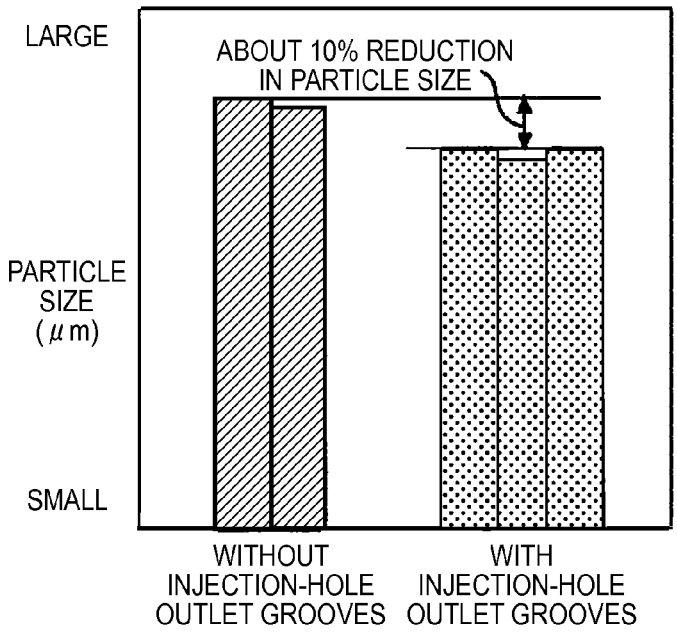
FIG. 6 is a view showing an atomization effect of fuel spray due to provision of the injection-hole outlet-side grooves, as compared with the case where the injection-hole outlet-side grooves are not provided, under a situation where the fuel pressure is equal.

FIG. 5 is a perspective view showing flow of the fuel injected through the injection hole 22 and the injection-hole outlet-side grooves 24. FIG. 6 is a view showing an atomization effect of fuel spray obtained by providing the injection-hole outlet-side grooves 24, as compared with the case where the injection-hole outlet-side grooves 24 are not provided, under a situation where the fuel pressure is equal.

Initially, in the fuel injection valve 10 of this embodiment, an upstream region of the injection hole 22 as viewed in the main flow direction of the fuel is formed as the tapered portion 22*a*, as described above; thus, the injection hole 22 is formed so that the passage cross-sectional area becomes larger toward the upstream side in the main flow direction of the fuel, as it proceeds from the inlet side to the outlet side. With this arrangement, separation of the fuel that flows into the injection hole 22 can be promoted, so that the fuel flowing into the injection 22 in the main flow direction of the fuel can be effectively deflected to the region of the downstream side (the inner wall surface 22*b* side) in the main flow direction, as shown in FIG. 3. As a result, reduction of the film thickness of the fuel ejected from the outlet of the injection hole 22 can be promoted.

Furthermore, since the fuel injection valve 10 of this embodiment includes the above-described injection-hole outlet-side grooves 24 at the outlet portion of the injection hole 22, a part of the fuel flowing while spreading to the right and left along the inner wall surface 22*b* of the injection hole 22 as it proceeds from the inlet side to the outlet side is guided to the injection-hole outlet-side grooves 24. As a result, the flow amount of the main fuel ejected from the injection hole 22 without being guided to the injection-hole outlet-side grooves 24 is reduced, and therefore, the film thickness of the main fuel ejected from the injection hole 22 can be effectively reduced. Also, the use of the injection-hole outlet-side grooves 24 in addition to the injection hole 22 makes it possible to disperse a fuel spray injected into the injection space (intake port) 20 over a wider range, as compared with the case where the injection-hole outlet-side grooves 24 are not provided. In this point, too, reduction of the film thickness of the injected fuel can be better promoted. Further, a part of the fuel is ejected from the injection-hole outlet-side grooves 24 having a sufficiently smaller width than the injection hole size, so that the reduction of the film thickness of the injected fuel can be even better promoted.

Through the reduction of the film thickness of the injected fuel and the promotion of the dispersion as described above, contact between the fuel and air in the injection space 20 is promoted. As a result, the particle size of droplets of the injected fuel can be effectively reduced (by about 10%, in the test result shown in FIG. 6), as compared with the case where the injection-hole outlet-side grooves 24 are not provided, as shown in FIG. 6. Namely, according to the fuel injection valve 10 of this embodiment, it becomes possible to favorably realize promotion of atomization of fuel spray (reduction of the vaporization time). Then, the promotion of atomization of the fuel spray can be realized by devising the shape of the surrounding of the injection hole 22, without relying on increase of the fuel pressure.

Also, the injection-hole outlet-side grooves 24 in this embodiment are formed as grooves (recesses) that extend in directions in which the fuel flowing into the injection hole 22 is guided along the inner wall surface 22*b*, as described above. This arrangement makes it possible to guide the fuel to the injection-hole outlet-side grooves 24, without disturbing but utilizing the flow of the fuel that spreads while branching to the right and left along the inner wall surface 22, as it flows from the inlet side, to the outlet side in the injection hole 22. Consequently, the flow rate of the fuel injected from the injection-hole outlet-side grooves 24 can be kept extremely high, and, in this point, too, the reduction of the film thickness of the injected fuel is promoted.

Then, in this embodiment, as a specific example for providing such effects, the injection-hole outlet-side grooves 24 are formed as a pair of grooves that are formed in V shape such that the grooves are inclined toward the upstream side of the main flow direction, in the injection-hole plate 18 as viewed from the outlet side of the injection hole 22. In some cases, excessively increasing the depth of the injection-hole outlet-side grooves 24 formed in the injection-hole plate 18 may cause a problem in appropriately assuring the strength of the injection-hole plate 18 while taking account of its pressure resistance. The fuel deflected to the inner wall surface 22*b* side in the injection hole 22 spreads while branching to the right and left along the inner wall surface 22*b* as it flows from the inlet side to the outlet side in the injection hole 22, as described above. Accordingly, by forming the injection-hole outlet-side grooves 24 as a pair of grooves formed in V shape oriented as described above, as in this embodiment, it is possible to effectively take out a part of the fuel while reducing the groove depth, even in the case where the groove depth is restricted for the reason in terms of the strength of the injection-hole plate 18 as described above.

In the embodiment 1 as described above, the injection-hole outlet-side grooves 24 are formed as a pair of grooves formed in V shape such that the grooves are inclined toward the upstream side of the main flow direction, in the injection-hole plate 18 as viewed from the outlet side of the injection hole 22. However, the injection-hole outlet-side grooves according to this invention are not limited to those formed as described above. Namely, the injection-hole outlet-side grooves may be grooves that extend in directions away from the injection hole, toward the downstream side of the main flow direction of the fuel (namely, toward the side opposite to the injection-hole outlet-side grooves 24 shown in FIG. 4), in the injection-hole forming member as viewed from the outlet side of the injection hole, for example, provided that the injection-hole outlet-side grooves are connected to the injection hole at regions opposed to the main flow direction of the fuel directed toward the injection hole along a wall surface of the injection-hole forming member on the inner side of the fuel injection valve, in the injection-hole forming member as viewed from the outlet side of the injection hole. Further, the number of the injection-hole outlet-side grooves 24 according to this invention is not limited two, as shown in FIG. 4, but may be one, or three or more.

Also, in the embodiment 1 as described above, the injection-hole outlet-side grooves 24 have been illustrated by way of example as grooves that extend in the form of straight lines, and have a constant groove width. However, the injection-hole outlet-side groove according to this invention is not limited to the one formed as described above. Namely, the injection-hole outlet-side groove may be formed as a groove that extends in curved form in a direction away from the injection hole, and the groove width may change continuously or in steps, as the distance from the injection hole increases, for example.

In the embodiment 1 as described above, the injection-hole plate 18 corresponds to the "injection-hole forming member" according to this invention.

Embodiment 2

Figure 7:
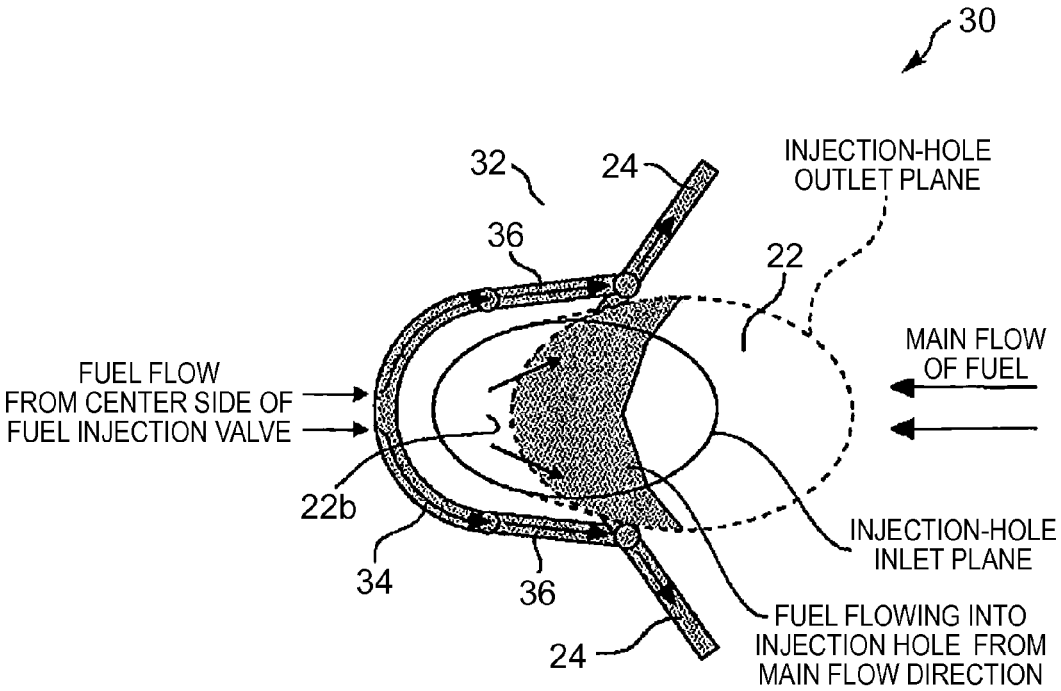
FIG. 7 is a view of an injection-hole plate included in a fuel injection valve of an embodiment 2 of this invention, as seen in the axial direction of the fuel injection valve (from the inlet side of the injection hole).
Figure 8:
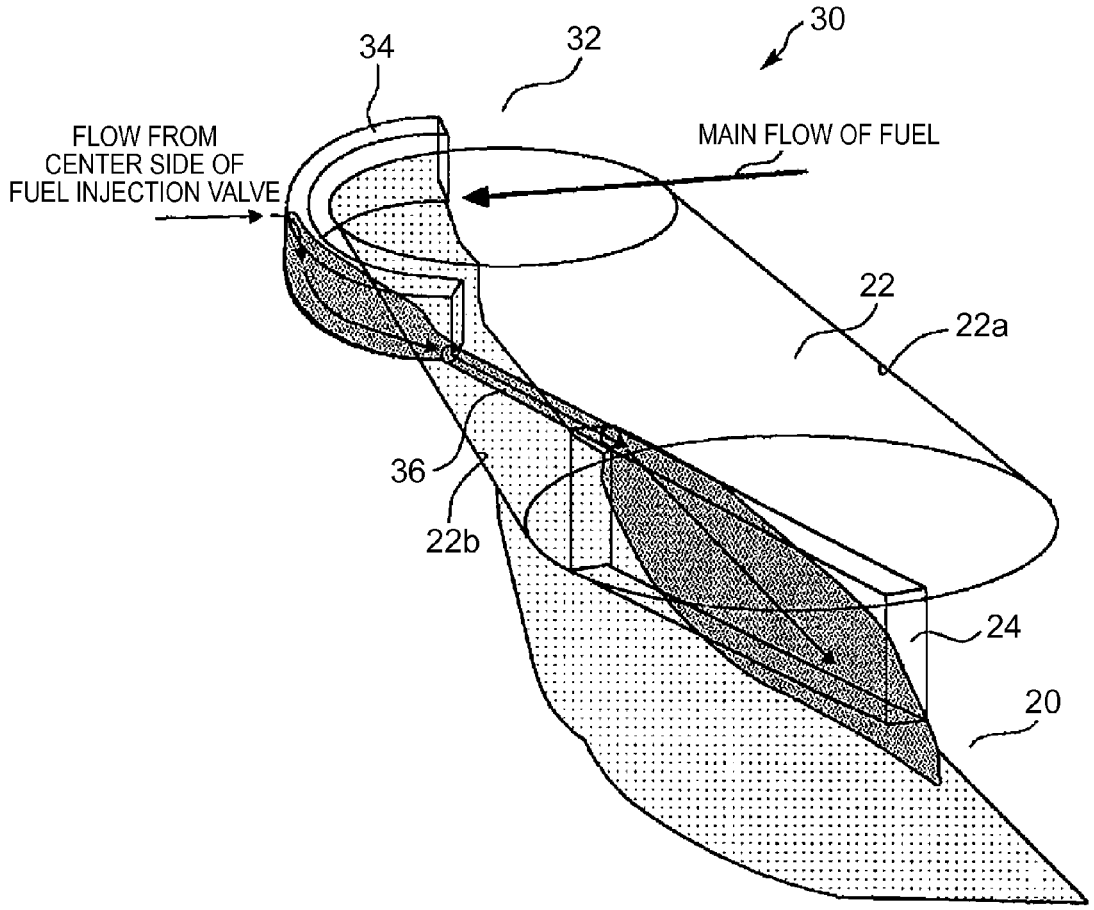
FIG. 8 is a perspective view showing flow of the fuel injected through the injection hole and each injection-hole outlet-side groove, and further showing flow of the fuel injected through the injection-hole outlet-side groove after passing through an injection-hole inlet-side groove and a fuel bypass.
Figure 9:
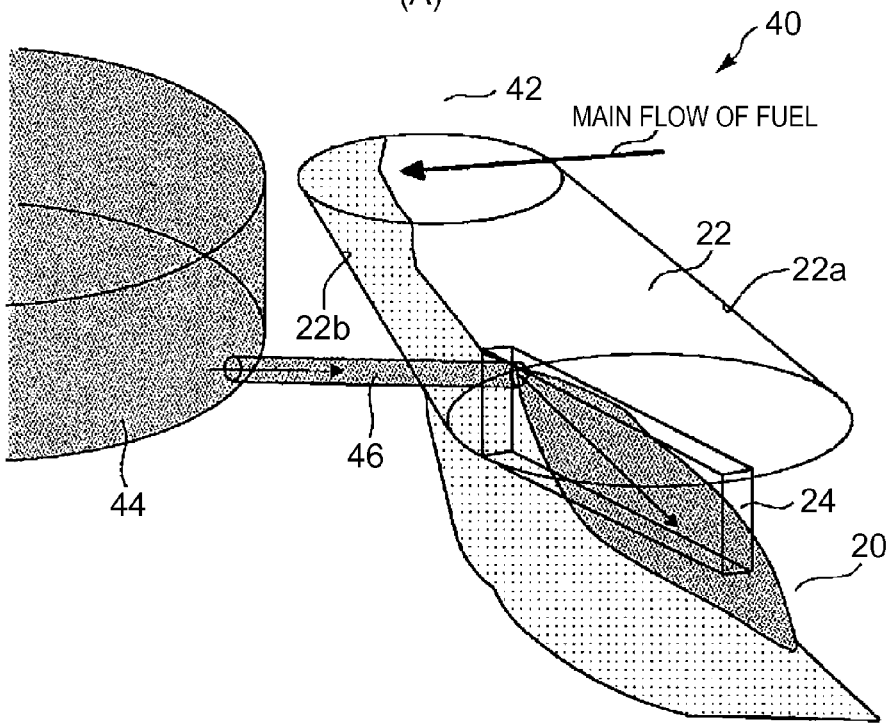
FIG. 9 is a view useful for explaining the construction of a fuel injection valve according to a modified example of the embodiment 2 of this invention.
Figure 9:
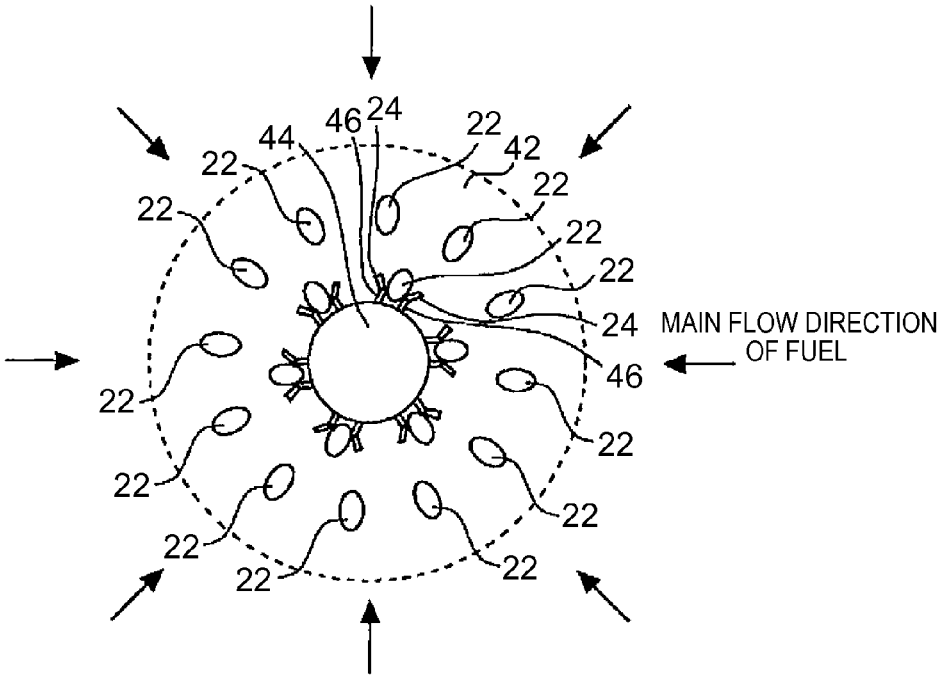

Referring next to FIG. 7 through FIG. 9, an embodiment 2 of this invention and its modified example will be described.

A fuel injection valve 30 of this embodiment is basically constructed similarly to the fuel injection valve 10 of the above-described embodiment 1, except that an injection-hole inlet-side groove 34 and fuel bypasses 36, which will be described later, are additionally provided.

FIG. 7 is a view of an injection-hole plate 32 included in the fuel injection valve 30 of the embodiment 2 of this invention, as seen in the axial direction of the fuel injection valve 30 (from the inlet side of an injection hole). FIG. 8 is a perspective view showing flow of the fuel injected through the injection hole 22 and each injection-hole outlet-side groove 24, and further showing flow of the fuel injected through the injection-hole outlet-side groove 24, via the injection-hole inlet-side groove 34 and the fuel bypass 36. In FIGS. 7, 8, the same reference numerals are assigned to the same elements as the constituent elements shown in FIG. 1 through FIG. 4, and explanation of these elements will be omitted or simplified.

As flows of the fuel directed toward the injection hole 22, a fuel flow from the center side of the fuel injection valve 30 (the center side of the injection-hole plate 32) exists, as denoted as "opposed flow" in FIG. 3(A) above, as a weak flow opposed to the main flow, in addition to "main flow" as the above-described main flow. If the fuel flow other than the main flow is permitted without being taken into consideration, this fuel flow collides with the main flow at the inlet of the injection hole 22. As a result, the flow rate of the main flow is reduced in the inlet portion of the injection hole 22, and reduction of the film thickness of the fuel ejected from the injection hole 22 is impeded.

Then, in this embodiment, the injection-hole inlet-side groove 34 is formed at a position close to the injection hole 22 in a region opposed to the main flow direction of the fuel, in the injection plate 32 as viewed from the inlet side of the injection hole 22. More specifically, as one example, the injection-hole inlet-side groove 34 is formed as a U-shaped notched groove that surrounds the periphery of the inlet of the injection hole 22, in the injection-hole plate 32 as viewed from the inlet side of the injection hole 22.

Further, in this embodiment, the fuel bypass 36 is formed in the injection-hole plate 32, as a passage that communicates the injection-hole inlet-side groove 34 with each of the injection-hole outlet-side grooves 24. In other words, the fuel bypass 36 is formed as a passage that extends through the injection-hole plate 32 from the injection-hole inlet-side groove 34 toward the injection-hole outlet-side groove 24 without intersecting the injection hole 22. The passage diameter of the fuel bypass 36 is set to substantially the same dimension as the width of the injection-hole outlet-side groove 24.

According to the fuel injection valve 30 of this embodiment as described above, the provision of the injection-hole inlet-side groove 34 and fuel bypasses 36 constructed as described above makes it possible to allow the fuel flow opposed to the main flow to escape into the injection-hole inlet-side groove 34. Therefore, the fuel flow opposed to the main flow can be prevented from entering the injection hole 22. As a result, the flow rate of the main flow is prevented from being reduced due to interference of this fuel flow, and reduction of the film thickness of the fuel injected from the injection hole 22 can be prevented from being impeded.

Also, the fuel flowing into the injection-hole inlet-side groove 34 passes through the injection-hole outlet-side grooves 24 via the fuel bypasses 36, and is injected into the injection space 20. Thus, the flow of the fuel flowing from the injection-hole inlet-side groove 34 is an independent fuel flow that does not join the main fuel flow through the injection hole 22, so that the main fuel flow can be prevented from being disturbed or blocked by this fuel flow.

Further, according to the fuel injection valve 30 of this embodiment, the injection-hole outlet-side grooves 24 for taking out a part of the fuel flowing into the injection hole 22 are commonly used, as passages for allowing ejection of the fuel that flows into the injection-hole inlet-side groove 34 and then passes through the fuel bypasses 36. With this arrangement, the injection directions of the fuel from the injection-hole inlet-side groove 34 side are aligned with the injection directions of the injection-hole outlet-side grooves 24. Also, the fuel from the injection-hole inlet-side groove 34 side is injected by use of the injection-hole outlet-side grooves 24 having a sufficiently smaller width than the injection hole size; therefore, the film thickness of the fuel can be favorably reduced.

In the embodiment 2 as described above, the injection-hole inlet-side groove 34 is formed as a U-shaped notched groove that surrounds the periphery of the inlet of the injection hole 22, in the injection plate 32 as viewed from the inlet side of the injection hole 22. However, the injection-hole inlet-side groove according to this invention is not limited to the one formed as described above, but may be one that will be described below with reference to FIG. 9, for example.

FIG. 9 is a view useful for explaining the construction of a fuel injection valve 40 according to a modified example of the embodiment 2 of this invention. More specifically, FIG. 9(A) is a perspective view showing the arrangement around one injection hole 22, and FIG. 9(B) is a view of an injection-hole plate 42 as seen in the axial direction of the fuel injection valve 40. In FIG. 9, the same reference numerals are assigned to the same elements as the constituent elements shown in FIG. 1 through FIG. 4 above, and explanation of these elements will be omitted or simplified.

The fuel injection valve 40 shown in FIG. 9 is basically constructed similarly to the fuel injection valve 30 according to the embodiment 2 as described above, except that the arrangement of an injection-hole inlet-side groove 44 and fuel bypasses 46 is different from the arrangement of the injection-hole inlet-side groove 34 and the fuel bypasses 36.

In the arrangement shown in FIG. 9, the injection-hole inlet-side groove 44 is formed as a cylindrical groove (recess), in a central portion of the fuel injection valve 40 (a central portion of the injection-hole plate 42). As shown in FIG. 9(B), a plurality of injection holes 22 are formed around the injection-hole inlet-side groove 44 such that two arrays of the injection holes 22 are arranged in a radial fashion, and the injection holes 22 are spaced at given angles in radial directions of the injection-hole plate 42. Each of the first array of injection holes 22 closer to the injection-hole inlet-side groove 44 is formed with fuel bypasses 46, as passages that communicate the injection-hole inlet-side groove 44 with the respective injection-hole outlet-side grooves 24 of each injection hole 22.

As shown in FIG. 9, the provision of the injection-hole inlet-side groove 44 in the central portion of the injection-hole plate 42 makes it possible to prevent the main flow of the fuel toward each injection hole 22 of the first and second arrays from being disturbed or blocked due to interference of fuel flow opposed to the main flow. Also, other than this, the fuel injection valve 40 can basically yield effects similar to the above-described effects provided by the fuel injection valve 30 of the embodiment 2. The main flow directions of the fuel in the fuel injection valve 40 shown in FIG. 9, which are different from those of the above-described fuel injection valves 10, 30, are directions from the radially outer side of the injection-hole plate 42 toward the center side thereof. Thus, the respective injection holes 22 of the oval shape and the injection-hole outlet-side grooves 24 are oriented in directions shown in FIG. 9 corresponding to the main flow directions. Also, in FIG. 9(B), injection holes 22 of the second array are also provided with the injection-hole outlet-side grooves 24, though they are not illustrated in the drawings.

In the embodiment 2 as described above, the fuel bypass 36 is formed as a passage that communicate the injection-hole inlet-side groove 34 with each of the injection-hole outlet-side grooves 24. However, the fuel bypass according to this invention is not limited to the one formed as described above. Namely, the fuel bypass may be a passage that communicates directly with the injection space, without any injection-hole outlet-side groove interposed therebetween, provided that the fuel bypass is formed as a passage that extends through the injection-hole forming member without intersecting the injection hole.

In the embodiment 2 as described above, the injection-hole plate 32 corresponds to the "injection-hole forming member" according to the invention.

In the embodiments 1 and 2 as described above, the arrangement in which the injection-hole plate 18, etc. is attached to a distal end portion of the fuel injection valve 10, etc. on one side thereof facing the injection space 20 of the fuel, has been illustrated by way of example. However, the injection-hole forming member according to the invention is not limited to a plate-like member, like the above injection-hole plate 18, etc., provided separately from the valve body. Namely, the injection-hole forming member may be the valve body itself in which at least one injection hole is formed, for example.

EXPLANATION OF REFERENCE NUMERALS

10, 30, 40 fuel injection valve
12 valve body
12*a* seat portion of valve body
14 needle valve
16 fuel passage
18, 32, 42 injection-hole plate
18*a* inner wall surface of injection-hole plate
20 injection space
22 injection hole
22*a* tapered portion of injection hole
22*b* inner wall surface of injection hole
24 injection-hole outlet-side groove
34, 44 injection-hole inlet-side groove
36, 46 fuel bypass

The invention claimed is:

1. A fuel injection valve that injects fuel, comprising:

a fuel passage that is formed in an interior of the fuel injection valve and allows the fuel to flow therethrough; and an injection-hole forming member that is a member that separates an injection space into which the fuel is injected, from the fuel passage, and is formed with at least one injection hole for ejecting the fuel from the fuel passage toward the injection space, the fuel injection valve being characterized in that:

the injection-hole forming member, as viewed from an outlet side of the injection hole, is formed with an injection-hole outlet-side groove connected to the injection hole in a region thereof opposed to a main flow direction of the fuel directed toward the injection hole along a wall surface of the injection-hole forming member inside the fuel injection valve, the injection-hole outlet-side groove is formed so as to extend in a direction away from the injection hole;

the injection-hole forming member, as viewed from an inlet side of the injection hole, is formed with an injection-hole inlet-side groove at a position close to the injection hole, in a region thereof opposed to the main flow direction of the fuel, and a fuel bypass that is a passage communicating with the injection-hole inlet-side groove, and extends through the injection-hole forming member without intersecting the injection hole, is formed in the injection-hole forming member.

2. The fuel injection valve according to claim 1, characterized in that the injection-hole outlet-side groove is formed as a groove that extends in a direction in which the fuel flowing into the injection hole is guided along an inner wall surface of the injection hole.

3. The fuel injection valve according to claim 1, characterized in that the injection-hole outlet-side groove comprises a pair of grooves formed in V shape such that the grooves are inclined toward an upstream side of the main flow direction of the fuel, in the injection-hole forming member as viewed from the outlet side of the injection hole.

4. The fuel injection valve according to claim 1, characterized in that the fuel bypass is formed as a passage that communicates the injection-hole inlet-side groove with the injection-hole outlet-side groove.

5. The fuel injection valve according to claim 1, characterized in that the injection hole is formed such that a passage cross-sectional area of an outlet-side region thereof becomes larger toward an upstream side of the main flow direction of the fuel, relative to a passage cross-sectional area of an inlet-side region thereof.

* * * * *